US011713621B2

(12) United States Patent
Diamond et al.

(10) Patent No.: US 11,713,621 B2
(45) Date of Patent: Aug. 1, 2023

(54) KIT OF PARTS FOR ASSEMBLING A CONTROL ASSEMBLY FOR A ROLLER BLIND

(71) Applicant: Fourds Limited, Magherafelt (GB)

(72) Inventors: Cormac Diamond, Magherafelt (GB); Frank McCullagh, Magherafelt (GB); Kevin McCullagh, Magherafelt (GB); Patrick McGirr, Magherafelt (GB); Kathryn Bleakley, Magherafelt (GB)

(73) Assignee: Fourds Limited, Magherafelt (GB)

( * ) Notice: Subject to any disclaimer, the term of this patent is extended or adjusted under 35 U.S.C. 154(b) by 0 days.

(21) Appl. No.: 17/772,341

(22) PCT Filed: Oct. 12, 2020

(86) PCT No.: PCT/EP2020/078635
§ 371 (c)(1),
(2) Date: Apr. 27, 2022

(87) PCT Pub. No.: WO2021/083652
PCT Pub. Date: May 6, 2021

(65) Prior Publication Data

US 2022/0349253 A1 Nov. 3, 2022

(30) Foreign Application Priority Data

Oct. 28, 2019 (GB) ..... 1915613

(51) Int. Cl.
*E06B 9/42* (2006.01)
*E06B 9/78* (2006.01)
(Continued)

(52) U.S. Cl.
CPC ..... *E06B 9/78* (2013.01); *E06B 9/42* (2013.01); *E06B 9/58* (2013.01); *E06B 9/68* (2013.01); *E06B 9/90* (2013.01); *E06B 2009/785* (2013.01)

(58) Field of Classification Search
CPC ..... E06B 9/78; E06B 9/90; E06B 9/68; E06B 9/58; E06B 2009/785; E06B 9/42
See application file for complete search history.

(56) References Cited

U.S. PATENT DOCUMENTS 5,009,259 A 4/1991 Miloslaus
9,834,986 B2 * 12/2017 Bohlen ..... E06B 9/62
(Continued)

FOREIGN PATENT DOCUMENTS

| | | |
|---|---|---|
| EP | 2053193 | 4/2009 |
| ES | 2311328 | 2/2009 |
| GB | 2442961 | 4/2008 |

OTHER PUBLICATIONS

International Search Report of corresponding PCT Application No. PCT/EP2020/078635, dated Feb. 4, 2021.
(Continued)

*Primary Examiner* — Beth A Stephan
(74) *Attorney, Agent, or Firm* — Gardner, Linn, Burkhart & Ondersma LLP

(57) ABSTRACT

A kit of parts for assembling a control assembly for a roller blind includes a plurality of driven parts each having a tubular body with a different diameter and/or profile adapted to be inserted into and drivingly engage a respective roller blind tube. The kit further includes a plurality of mounting parts each having an outer face incorporating a different arrangement of securing formations adapted to be engageable with a respective mounting bracket, and a drive part including (i) a housing adapted to be coupled with any one
(Continued)

of the mounting parts and (ii) a drive rotatingly mounted within the housing and adapted to be coupled with any one of the driven parts.

14 Claims, 5 Drawing Sheets

(51) Int. Cl.

| | |
|---|---|
| ***E06B 9/58*** | (2006.01) |
| ***E06B 9/68*** | (2006.01) |
| ***E06B 9/90*** | (2006.01) |

(56) References Cited

U.S. PATENT DOCUMENTS

| | | | | |
|---|---|---|---|---|
| 10,309,152 | B2 | 6/2019 | Greening | |
| 2010/0276530 | A1* | 11/2010 | Di Stefano | E06B 9/50 242/370 |
| 2013/0190119 | A1* | 7/2013 | Barnes | E06B 9/50 474/144 |
| 2021/0054692 | A1* | 2/2021 | Marzilli | E06B 9/42 |

OTHER PUBLICATIONS

UK Search Report of corresponding Application No. GB1915613.2, dated Apr. 14, 2020.

* cited by examiner

KIT OF PARTS FOR ASSEMBLING A CONTROL ASSEMBLY FOR A ROLLER BLIND

CROSS REFERENCE TO RELATED APPLICATIONS

The present application is a § 371 national stage of International Application PCT/EP2020/078635, filed Oct. 12, 2020, which claims priority benefit to U.K. Pat. Application Ser. No. 1915613.2, filed Oct. 28, 2019, both of which are hereby incorporated herein by reference in their entireties.

FIELD OF THE INVENTION

The present invention relates to a kit of parts for assembling a modular control assembly for a roller blind so that the control assembly can be used with a selected one of a number of different designs of roller blind tubes and mounting brackets and to a method of assembling the control assembly from the kit of parts.

BACKGROUND OF THE INVENTION

Roller blinds for covering window and door openings commonly comprise a fabric blind wound onto a tube, the tube being rotatably mounted in an upper side of a window or door opening via mounting brackets secured to the sides of the window or door opening at either end of the tube, and the roller blind tube being coupled to at least one of the mounting brackets via a control assembly adapted to raise and lower the blind by rotating the tube. Commonly, the control assembly comprises a driven part insertable into an end of the roller blind tube, a drive part, such as a chain wheel around which an endless adjusting chain passes to depend from the control assembly, the drive part being coupled to the driven part for rotation therewith, and a housing part, including a chain guard surrounding part of the chain wheel and guiding the endless chain thereon, an outer surface of the housing part including formations adapted to secure the housing part to the adjacent mounting bracket. The control assembly may incorporate a clutch arrangement to prevent the weight of the blind from rotating the driven part of the assembly.

The internal diameter of the roller blind tube and profile of the tube can vary greatly between different products and between different manufacturers. Likewise, the design of the formations used to secure the housing part of the control assembly to the mounting brackets can differ significantly between different products and between different manufacturers. Therefore, should a customer wish to change the control assembly it is usually necessary to replace the entire blind assembly, including the roller blind tube and mounting brackets.

SUMMARY OF THE INVENTION

According to the present invention there is provided a kit of parts for assembling a control assembly for a roller blind comprising a plurality of driven parts each comprising a tubular body, the tubular body of each of the plurality of driven parts having a different diameter and/or profile adapted to be inserted into and drivingly engage a respective roller blind tube, a plurality of mounting parts each having an outer face incorporating a different arrangement of securing formations adapted to be engageable with a respective mounting bracket, and a drive part comprising a housing adapted to be coupled with any one of the mounting parts and a drive or drive means rotatingly mounted within the housing and adapted to be coupled with any one of the driven parts.

The kit of parts may further comprise one or more biasing assemblies, each being adapted to be coupled with at least one of the plurality of driven parts for imparting a rotational biasing force against a roller blind tube into which the selected driven part is inserted.

The tubular body of each driven part may comprise a cylindrical outer part having an outer surface of a specific diameter and/or incorporating an arrangement of surface formations and/or channels/recesses adapted to engage with a tube of particular roller blind assembly.

Each driven part of the kit of parts may include a central bore having a diameter and length adapted to receive a central pin extending from the selected mounting part, the pin including at least one resiliently deformable leg having a length selected to pass through the central bore of the selected driven part and terminating in an outwardly facing catch adapted to retain the central pin of the selected mounting part within the central bore of the selected driven part when assembled. The central pin may define a bush upon which the selected driven part may be guided and supported for rotation thereon when assembled.

The drive part of the kit of parts may include a central aperture arranged such that the central pin of selected mounting part passes therethrough before passing into the central bore of the selected driven part, when assembled. The drive of the drive part may include a drive formation adapted to engage the selected driven part to permit the transfer of rotation between the drive of the drive part and the selected driven part. The drive formation may comprise a segment of a tube dimensioned to fit around the central pin of the selected mounting part and be received within a suitably dimensioned region of the central bore of the selected driven part to rotatably engage the drive with the selected driven part when assembled.

Each of the plurality of mounting parts of the kit of parts may include a flange, the housing of the drive part incorporating a recess shaped to receive the flange of any one of the mounting parts therein. The securing formations may be formed on an outer face of the flange of at least one of the plurality of mounting parts. At least one of the plurality of mounting parts may be formed from two parts, a first part including the flange and a second part abutting an outer face of the flange of the first part, an outer face of the second part incorporating the securing formations thereon. The second part may incorporate a locating pin receivable within an aperture within the first part, the locating pin including one or more outwardly facing resilient retaining catches or claws adapted to secure the first part to the second part. An inner face of the flange may be provided with projections or other formations arranged to engage the housing of the drive part, when assembled, to prevent rotation between the selected mounting part and housing of the drive part.

According to a further aspect of the present invention there is provided a method of assembling a control assembly for a roller blind comprising selecting a driven part from a plurality of driven parts each comprising a tubular body, the tubular body of each of the plurality of driven parts having a different diameter and/or profile adapted to be inserted into and drivingly engage a respective roller blind tube, selecting a mounting part from a plurality of mounting parts each having an outer face incorporating a different arrangement of securing formations adapted to be engageable with a respective mounting bracket, and coupling the selected driven part and the selected mounting part with a drive part, the drive part comprising a housing adapted to be coupled to any one of the mounting parts and a drive or drive means rotatingly mounted within the housing and adapted to be coupled with any one of the driven parts.

These and other objects, advantages and features of the invention will become apparent upon review of the following specification in conjunction with the drawings.

BRIEF DESCRIPTION OF THE DRAWINGS

A kit of parts for assembling a control assembly for a roller blind in accordance with a first embodiment of the present invention will now be described, by way of example only, with reference to the accompanying drawings, in which:—

DETAILED DESCRIPTION OF THE PREFERRED EMBODIMENTS

Figure 1:
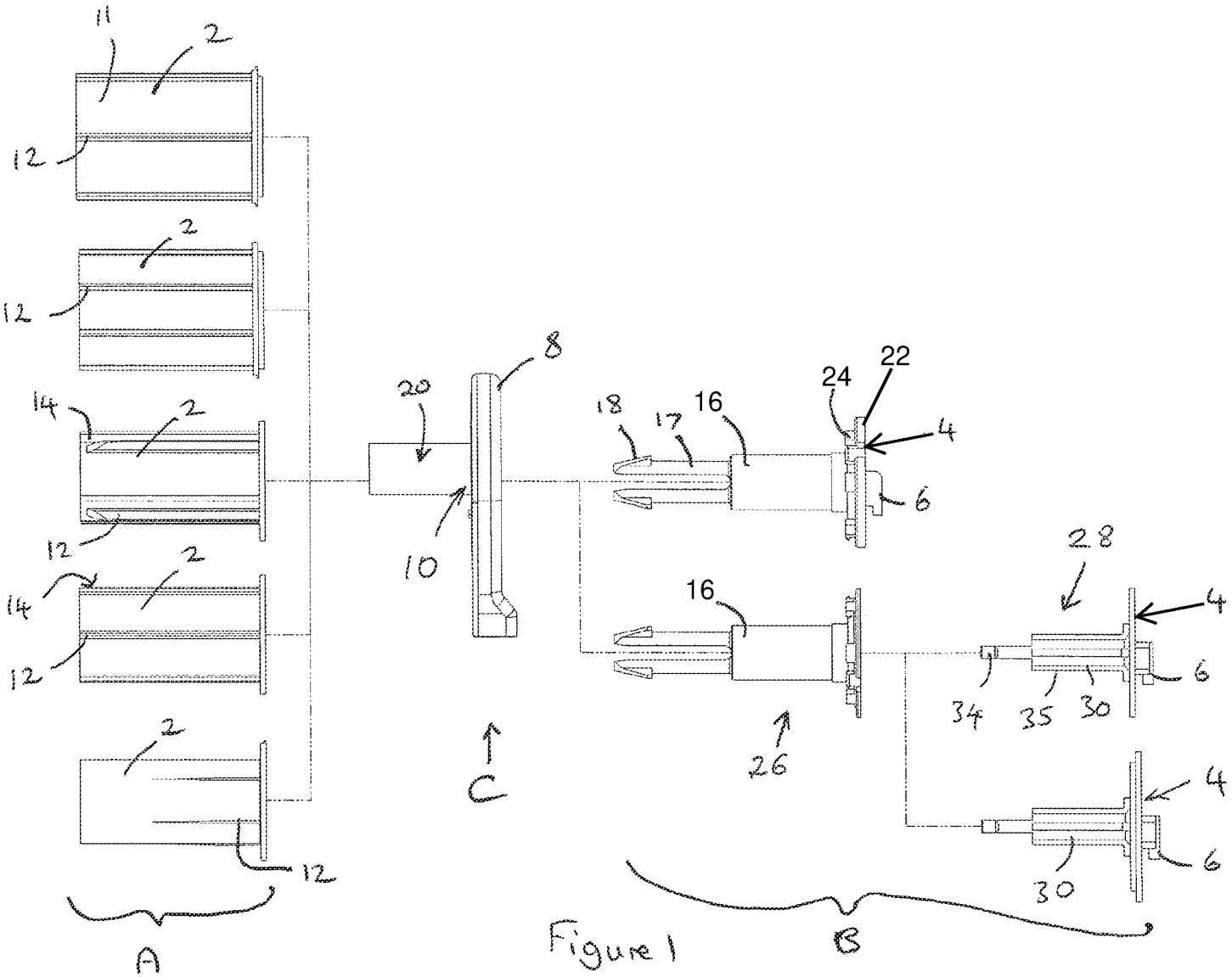
FIG. 1 is a side view of a kit of parts for assembling a control assembly for a roller blind in accordance with a first embodiment of the present invention.

As illustrated in FIG. 1, a kit of parts for assembling a control assembly for a roller blind in accordance with an embodiment of the present invention comprises a plurality of driven parts A, each comprising a tubular body 2, the tubular body 2 of each of the plurality of driven parts A having a different diameter and/or profile adapted to be inserted into and drivingly engage a respective roller blind tube, a plurality of mounting parts B each having an outer face 4 incorporating a different arrangement of securing formations 6 adapted to be engageable with a respective mounting bracket of a roller blind, and a drive part C comprising housing 8 adapted to be coupled with any one of the mounting parts B and a drive or drive means 10 rotatingly mounted within the housing 8 and adapted to be coupled with any one of the driven parts A.

In use, the customer is able to select one driven part A of the plurality of driven parts and one mounting part B of the plurality of mounting parts and assemble the selected driven part A and mounting part B with the drive part C to provide a control assembly for use with a particular combination of roller blind tube and mounting bracket.

Figure 2:
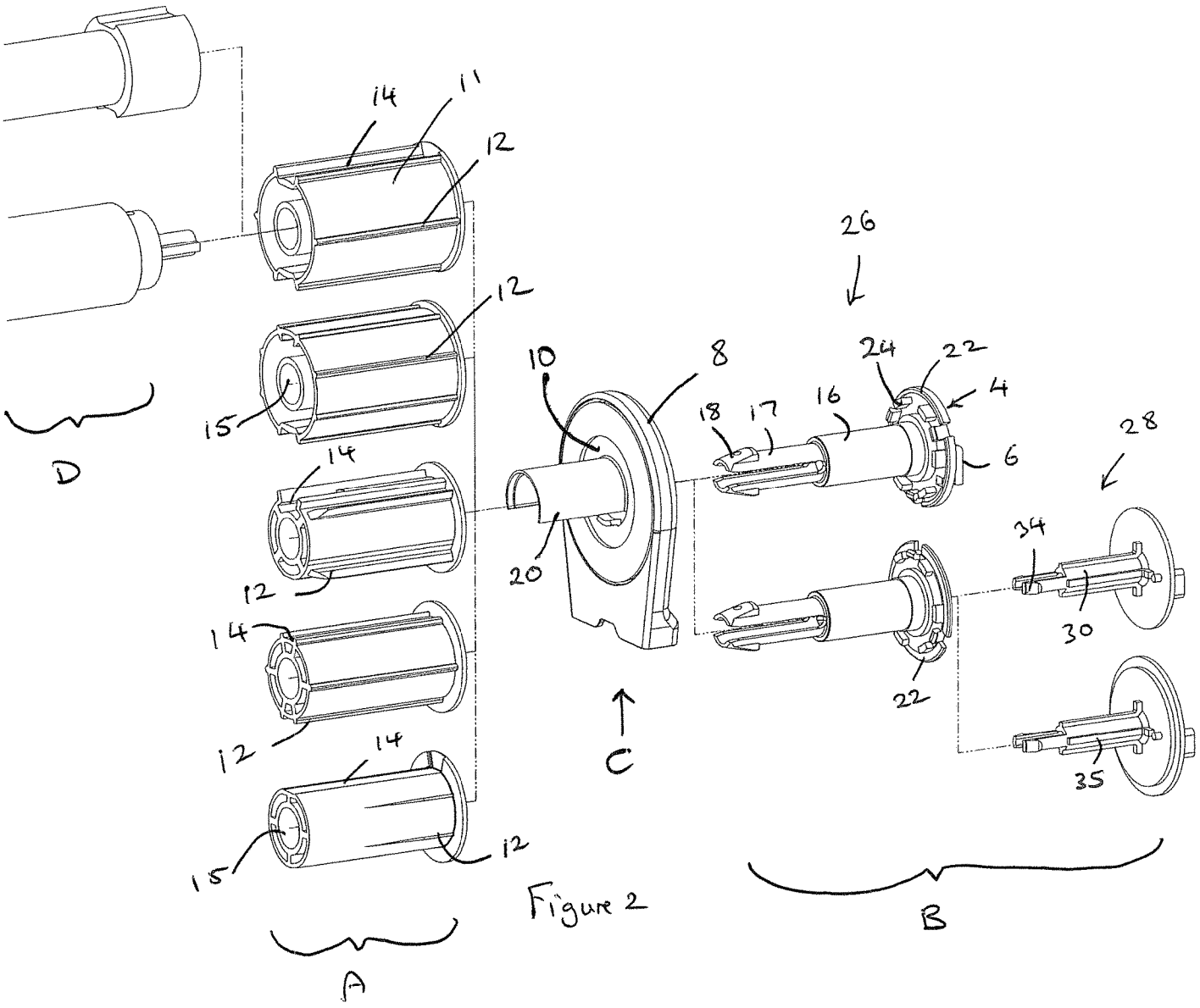
FIG. 2 is a perspective view of the kit of parts of FIG. 1 with the addition of optional biasing assemblies.

As illustrated in FIG. 2, the tubular body 2 of each driven part A comprises a cylindrical outer part 11 having an outer surface of a specific diameter and/or incorporating an arrangement of surface formations 12 (such as splines) and/or channels/recesses 14 adapted to engage with a tube of particular roller blind assembly. In use, the customer selects a particular one of the plurality of driven parts A to suit the tube of the particular roller blind assembly with which the assembled control assembly is desired to be used such that the selected driven part A can be secured to the roller blind tube and impart rotation to the roller blind tube from the drive part C of the assembled control assembly.

In the embodiment shown, each driven part A includes a central bore 15 having a diameter and length adapted to receive a central pin 16 extending from the selected mounting part B, the pin 16 including at least one resiliently deformable leg 17 (two resiliently deformable legs 17 being provided in the embodiment shown) having a length selected to pass through the central bore 15 of the selected driven part A and terminating in an outwardly facing catch 18 adapted to retain the central pin 16 of the selected mounting part B within the central bore 15 of the selected driven part A. The central pin 16 may define a bush upon which the driven part A may be guided and supported for rotation thereon.

The drive part C includes a central aperture 19 through which the central pin 16 of selected mounting part B may pass before passing into the central bore 15 of the selected driven part A. The drive 10 of the drive part C includes a drive formation 20 adapted to engage the selected driven part A to permit the transfer of rotation between the drive 10 of the drive part C and the selected driven part A. In the embodiment shown in the drawings, the drive formation 20 comprises a segment of a tube dimensioned to fit around the central pin 16 of the selected mounting part and be received within a suitably dimensioned region of the central bore 15 of the selected driven part to rotatably engage the drive 10 with the selected driven part A.

Each mounting part B includes a flange 22. The outer face 4 of the mounting part B upon which the securing formations 6 is formed may comprise the outer face of the flange 22. An inner face of the flange 22 may be provided with projections or other formations 24 arranged to engage the housing 8 of the drive part C to prevent rotation between the mounting part and housing 8 of the drive part C. The housing 8 of the drive part C may incorporate a recesses shaped to receive the flange 22 of the mounting part B therein.

As illustrated in the drawings, at least one of the mounting parts B may be formed from two parts, a first part 26, including the central pin 16 extending therefrom to pass through the drive part C and be received and retained within the central bore 15 of the driven part A, and a second part 28 abutting an outer face of the flange 22 of the first part 26, an outer face 4 of the second part 28 incorporating the securing formations 6 thereon and including a central locating pin 30 receivable within a central aperture 32 within the first part 26, the locating pin 30 terminating in one or more outwardly facing resilient retaining catches or claws 34 adapted to secure the first part 26 to the second part 28.

The locating pin 30 of the second part 28 may include splines 35 or have a cross sectional profile otherwise shaped to engage correspondingly shaped recesses in the central aperture 32 in the first part 16 to prevent relative rotation between the first and second parts 26,28.

A plurality of different second parts 28 may be provided, each having identical locating pins 30 but different arrangements of securing formations 6 formed on the outer face 4 thereof individually adapted to cooperate with different mounting brackets, such that a common first part 26 can be used with different second parts 28 to enable the assembled control assembly to be used with different styles or designs of mounting brackets.

The drive 10 of the drive part C may comprise a chain wheel or sprocket (not shown) having an endless chain or cord engaged therewith, the housing 8 defining a chain/cord guide and chain/cord guard surrounding a portion of the chain wheel and including an opening at a lower side from which the endless chain or cord may depend, in use. The drive 10 may incorporate a clutch mechanism to prevent the weight of the blind from rotating the chain wheel or sprocket.

Figure 3:
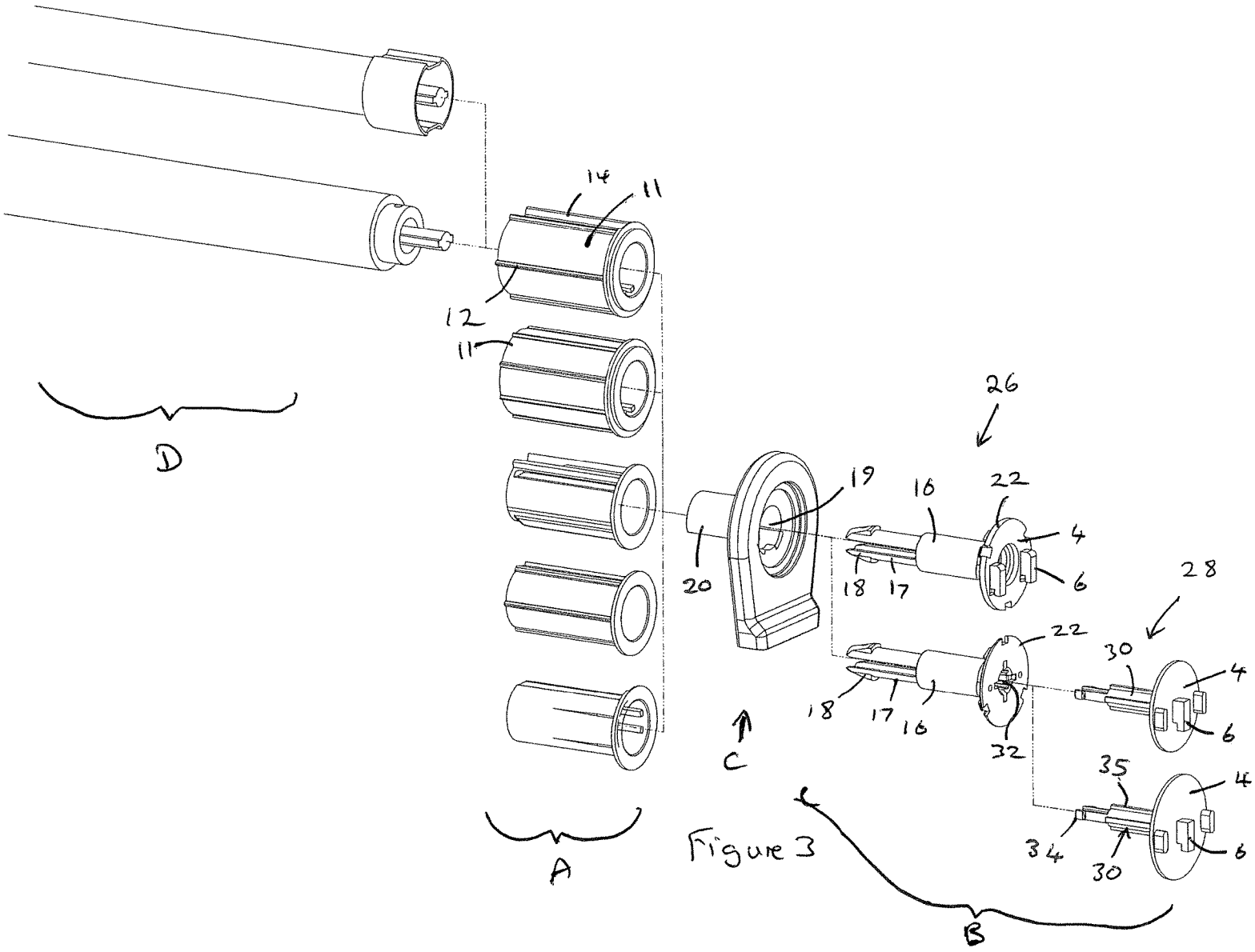
FIG. 3 is a further perspective view of the kit of parts of FIG. 2.

As illustrated in FIGS. 2 and 3, one or more biasing assemblies D may be provided for imparting a rotational biasing force against a roller blind tube into which the selected driven part is inserted, such as in a direction to wind the blind onto the roller blind tube, thereby counteracting the weight of the blind fabric. A number of differently designed biasing assemblies D may be provided in the kit of parts to suit different designs of roller blind tube and/or different operational requirements, whereby the user can selected a desired biasing assembly D. One or more of the plurality of driven parts A and/or mounting parts B may be adapted to cooperate with the (or each) biasing assembly D. For example, the inner shape of the deformable legs 17 of the selected mounting part B and the inner shape of the cylindrical outer part 11 of the selected driven part A may be adapted to cooperate with respective parts of the selected biasing assembly D.

Figure 4:
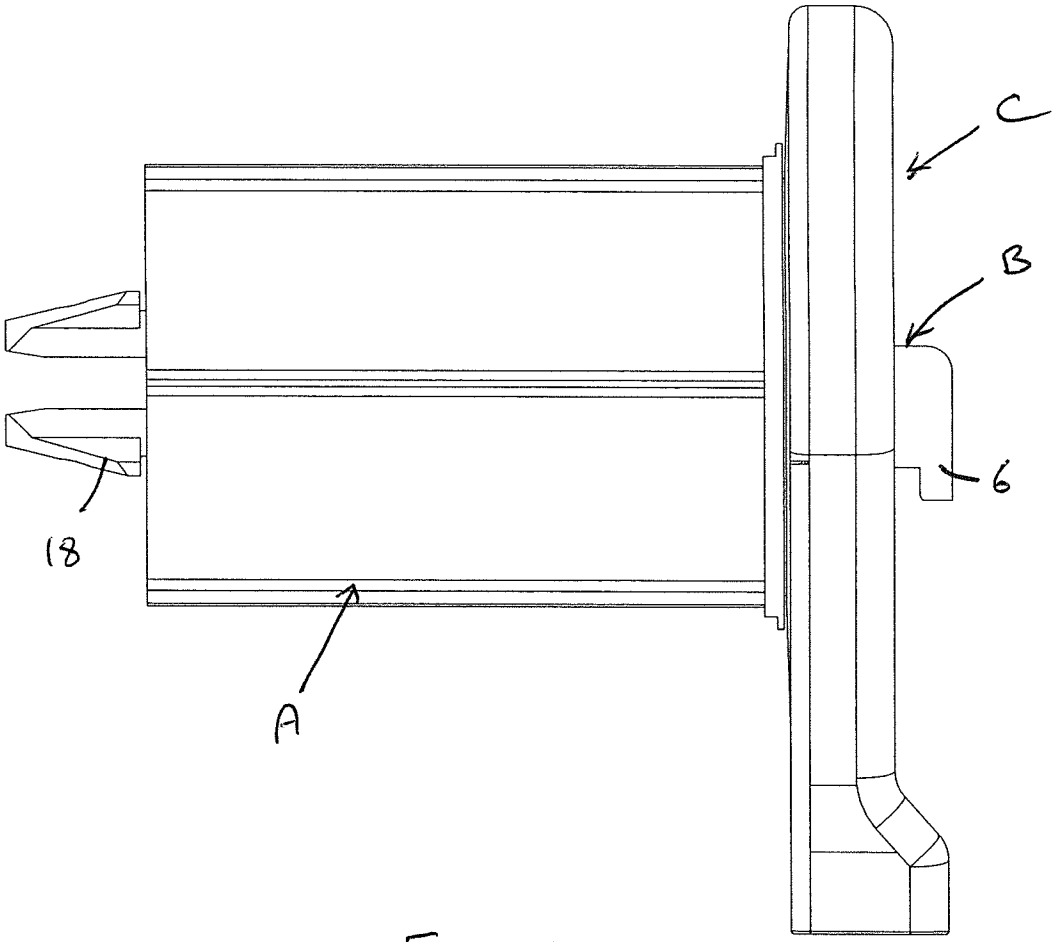
FIG. 4 is a side view of a control assembly for a roller blind assembled from the kit of parts of FIG. 1.

As illustrated in FIG. 4, the kit of parts may be assembled by the customer to provide a control assembly for use with a particular combination of roller blind tube and mounting bracket. A specific driven part A may be selected from the plurality of driven parts A to cooperate with the particular design of the roller blind tube being used. A specific mounting part B (or selected combination of first and second parts 26,28 thereof) may be selected from the plurality of mounting parts B to cooperate with the particular design of mounting bracket being used. The control assembly may be assembled by passing the central pin 16 of the selected mounting part B through the central aperture 19 of the drive part C while inserting the drive formation 20 of the drive part C into the selected driven part A and passing the central pin 16 of the mounting part B through the central bore 15 of the selected driven part until the outwardly facing catches 18 or the (or each) resiliently deformable leg 17 extend beyond the central bore 15, thereby retaining the selected driven, drive and mounting parts together. This allows a common drive part C to be used with numerous different types of blind roller tube and mounting bracket combinations.

Figure 5:
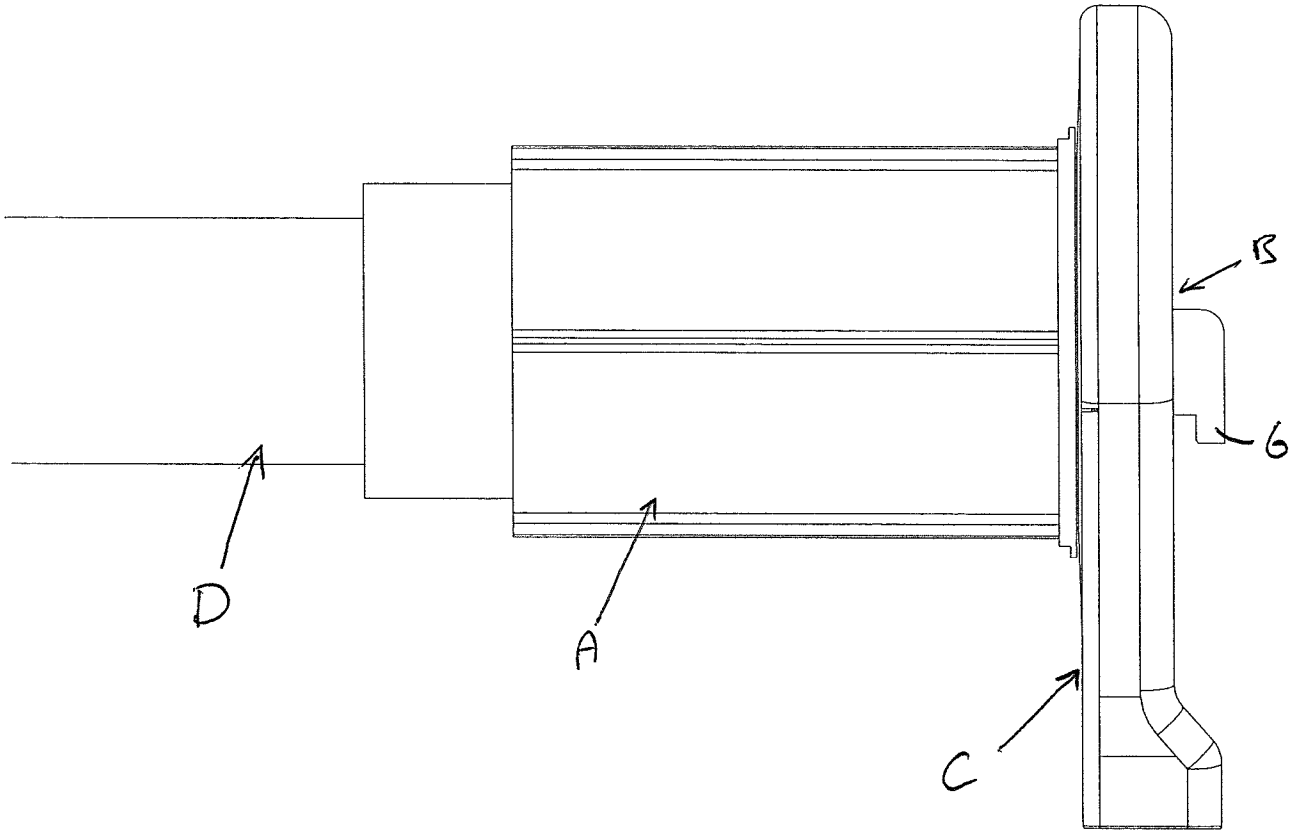
FIG. 5 is a side view of a control assembly for a roller blind assembled from the kit of parts of FIG. 2.

FIG. 5 illustrates the kit of parts assembled by the customer where it is desired or required to incorporate a specific biasing assembly D.

The invention is not limited to the embodiment described herein but can be amended or modified without departing from the scope of the present invention as defined by the appended claims as interpreted according to the principles of patent law including the doctrine of equivalents.

The invention claimed is:

1. A kit of parts for assembling a control assembly for a roller blind, said kit of parts comprising:

a plurality of driven parts each comprising a tubular body, said tubular body of each of said plurality of driven parts having a different diameter and/or profile adapted to be inserted into and drivingly engage a respective roller blind tube;

a plurality of mounting parts each having an outer face incorporating a different arrangement of securing formations adapted to be engageable with a respective mounting bracket; and a drive part comprising (i) a housing adapted to be coupled with any one of said mounting parts, and (ii) a drive rotatingly mounted within said housing and adapted to be coupled with any one of said driven parts.

2. The kit of parts of claim 1, further comprising one or more biasing assemblies, said one or more biasing assemblies being adapted to be coupled with at least one of said plurality of driven parts for imparting a rotational biasing force against the respective roller blind tube into which a selected one of said driven parts is inserted.

3. The kit of parts of claim 1, wherein said tubular body of each of said driven parts comprises a cylindrical outer part having an outer surface of a specific diameter and/or incorporating an arrangement of surface formations and/or channels/recesses adapted to engage with the respective roller blind tube of a particular roller blind assembly.

4. The kit of parts of claim 1, wherein each of said driven parts includes a central bore having a diameter and length adapted to receive a central pin extending from a selected one of said mounting parts, said pin including at least one resiliently deformable leg having a length selected to pass through said central bore of the selected one of said driven parts and terminating in an outwardly facing catch adapted to retain said central pin of the selected one of said mounting parts within said central bore of the selected one of said driven parts when assembled.

5. The kit of parts of claim 4, wherein said central pin defines a bush upon which the selected one of said driven parts may be guided and supported for rotation thereon when assembled.

6. The kit of parts of claim 4, wherein said drive part includes a central aperture arranged such that said central pin of the selected one of said mounting parts passes therethrough before passing into said central bore of the selected one of said driven parts, when assembled.

7. The kit of parts of claim 6, wherein the drive of said drive part includes a drive formation adapted to engage the selected one of said driven parts to permit transfer of rotation between the drive of said drive part and the selected one of said driven parts.

8. The kit of parts of claim 7, wherein said drive formation comprises a segment of a tube dimensioned to fit around said central pin of the selected one of said mounting parts and be received within a suitably dimensioned region of said central bore of the selected one of said driven parts to rotatably engage the drive with the selected one of said driven parts when assembled.

9. The kit of parts of claim 1, wherein each of said plurality of mounting parts includes a flange, said housing of said drive part incorporating a recess shaped to receive said flange of any one of said mounting parts therein.

10. The kit of parts of claim 9, wherein said securing formations are formed on an outer face of said flange of at least one of said plurality of mounting parts.

11. The kit of parts of claim 9, wherein at least one of said plurality of mounting parts is formed from first and second parts, said first part including said flange and said second part abutting an outer face of said flange of said first part, an outer face of said second part incorporating said securing formations thereon.

12. The kit of parts of claim 11, wherein said second part incorporates a locating pin receivable within an aperture within said first part, said locating pin including one or more outwardly facing resilient retaining catches or claws adapted to secure said first part to said second part.

13. The kit of parts of claim 9, wherein an inner face of said flange is provided with projections or other formations arranged to engage said housing of said drive part, when assembled, to prevent rotation between the selected one of said mounting parts and said housing of said drive part.

14. A method of assembling a control assembly for a roller blind, said method comprising:

selecting a driven part from a plurality of driven parts each comprising a tubular body, the tubular body of each of the plurality of driven parts having a different diameter and/or profile adapted to be inserted into and drivingly engage a respective roller blind tube;

selecting a mounting part from a plurality of mounting parts each having an outer face incorporating a different arrangement of securing formations adapted to be engageable with a respective mounting bracket; and coupling the selected driven part and the selected mounting part with a drive part, the drive part comprising (i) a housing adapted to be coupled to any one of the mounting parts, and (ii) a drive rotatingly mounted within the housing and adapted to be coupled with any one of the driven parts.

* * * * *